US009751335B2

(12) United States Patent
Zengo et al.

(10) Patent No.: US 9,751,335 B2
(45) Date of Patent: Sep. 5, 2017

(54) LIQUID DROPLET DRYING DEVICE, NON-TRANSITORY COMPUTER READABLE MEDIUM, AND IMAGE FORMING APPARATUS

(71) Applicant: FUJI XEROX CO., LTD., Tokyo (JP)

(72) Inventors: Takeshi Zengo, Kanagawa (JP); Akira Sakamoto, Kanagawa (JP); Jun Isozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/996,260

(22) Filed: Jan. 15, 2016

(65) Prior Publication Data

US 2017/0050447 A1 Feb. 23, 2017

(30) Foreign Application Priority Data

Aug. 17, 2015 (JP) ..... 2015-160593

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002
See application file for complete search history.

(56) References Cited

U.S. PATENT DOCUMENTS 6,114,654 A * 9/2000 Nishiwaki ..... B23K 26/067 219/121.7
2005/0253913 A1* 11/2005 Yokoyama ..... B41J 11/002 347/102
2015/0158311 A1* 6/2015 Ogasawara ..... B41J 11/002 347/16

FOREIGN PATENT DOCUMENTS

JP 2015-112792 6/2015

* cited by examiner

*Primary Examiner* — Jason Uhlenhake
(74) *Attorney, Agent, or Firm* — Fildes & Outland, P.C.

(57) ABSTRACT

A liquid droplet drying device includes: a drying unit that includes a plurality of light sources emitting light to a liquid droplet ejected to a recording medium by a forming unit which ejects the liquid droplet to form an image and drying the image and in which an amount of light of each of the plurality of light sources is variable; and a correction unit that corrects the amount of light of each of the plurality of light sources so that a light amount distribution of the drying unit is within a range of a pre-decided target using light amount information obtained by reading the amount of light emitted from each of the plurality of light sources by a reading unit which reads the image formed on the recording medium by the forming unit.

9 Claims, 10 Drawing Sheets

LIQUID DROPLET DRYING DEVICE, NON-TRANSITORY COMPUTER READABLE MEDIUM, AND IMAGE FORMING APPARATUS

CROSS-REFERENCE TO RELATED APPLICATIONS

This application is based on and claims priority under 35 USC 119 from Japanese Patent Application No. 2015-160593 filed on Aug. 17, 2015.

BACKGROUND

Technical Field

The present invention relates to a liquid droplet drying device, a non-transitory computer readable medium, and an image forming apparatus.

SUMMARY

An aspect of the present invention provides a liquid droplet drying device includes: a drying unit that includes a plurality of light sources emitting light to a liquid droplet ejected to a recording medium by a forming unit which ejects the liquid droplet to form an image and drying the image and in which an amount of light of each of the plurality of light sources is variable; and a correction unit that corrects the amount of light of each of the plurality of light sources so that a light amount distribution of the drying unit is within a range of a pre-decided target using light amount information obtained by reading the amount of light emitted from each of the plurality of light sources by a reading unit which reads the image formed on the recording medium by the forming unit.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the invention will be described in detail with reference to the drawings. In the embodiments, a form in which an image forming apparatus according to the invention is applied to an inkjet type image forming apparatus will be exemplified in the description.

First Embodiment

First, the configuration of an image forming apparatus 10 according to the embodiment will be described with reference to FIGS. 1 to 3.

Figure 1:
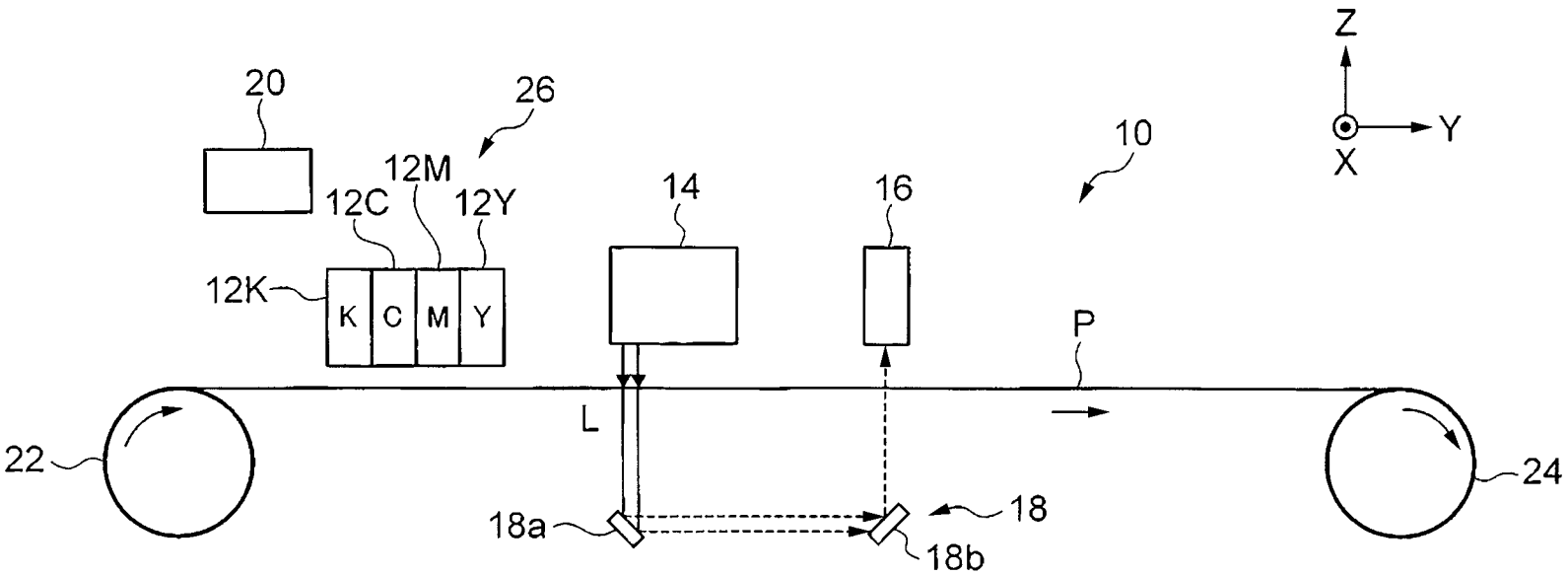
FIG. 1 is a schematic configuration diagram illustrating an example of the configuration of an image forming apparatus according to an embodiment.

As illustrated in FIG. 1, the image forming apparatus 10 includes a head unit 26, a drying unit 14, an inline sensor (ILS) 16, a correction optical system 18, a control unit 20, a sheet feeding roll 22, and a winding roll 24. The image forming apparatus 10 has a function of forming an image on the front surface of a continuous paper sheet P which is a recording medium and further forming an image on the rear surface of the continuous paper sheet P, as necessary. A configuration including the drying unit 14 and the correction optical system 18 configure a liquid droplet drying device according to the embodiment. Hereinafter, forming an image means "printing" in some cases.

The head unit 26 includes an inkjet head 12K that ejects an ink droplet (which is an example of a liquid droplet) to the continuous paper sheet P to form a K (black) image, an inkjet head 12C that forms a C (cyan) image, an inkjet head 12M that forms an M (magenta) image, and an inkjet head 12Y that forms a Y (yellow) image. The inkjet head 12K, the inkjet head 12C, the inkjet head 12M, and the inkjet head 12Y are arranged in this order in a transport direction (the +Y direction indicated by an arrow denoted by reference numeral P in FIG. 1: hereinafter referred to as a "sheet transport direction") of the continuous paper sheet P to face the continuous paper sheet P from the upstream side to the downstream side.

In the embodiment, the arrangement order of the inkjet head 12K, the inkjet head 12C, the inkjet head 12M, and the inkjet head 12Y is merely an example and is not limited to the order in FIG. 1. In the following description, when K, C, M, and Y are not distinguished from each other, K, C, M, and Y denoted by the reference numerals are omitted.

The drying unit 14 is disposed on the downstream side of the head unit 26 in the sheet transport direction and dries the image formed on the continuous paper sheet P. In the embodiment, a drying device using a laser is adopted as the drying unit 14. The drying unit 14 includes a plurality of vertical cavity surface emitting laser (VCSEL) elements as heat sources drying the image formed on the continuous paper sheet P. The lasers serving as the heat sources are not limited to the VCSEL elements, but different types of laser elements, e.g., edge-emitting semiconductor laser elements, may be used.

The ILS 16 has a function of an image reading device when a printed state of a print in a printing process on the continuous paper sheet P is monitored. The ILS 16 is configured to include a light-emitting unit and a light-receiving unit (neither of which is illustrated). A reflection optical density (so-called optical density (OD) value) of the print region of the continuous paper sheet P is measured by emitting when light emitted from the light-emitting unit is reflected from the continuous paper sheet P and the reflected light is detected by the light-receiving unit. In the ILS 16, for example, a light-emitting diode (LED) or the like is used as the light-emitting unit and, for example, a charge coupled diode (CCD) or the like is used as the light-receiving unit.

In the image forming apparatus 10 according to the embodiment, the ILS 16 is further used as a light amount measurement device when light amount irregularity of the drying unit 14 is corrected. The details will be described below. The reflective inline sensor is not limited to the ILS 16, but a transmissive inline sensor may be used.

The correction optical system 18 is configured to include mirrors 18*a* and 18*b*. The correction optical system 18 is an optical system that guides a light flux L of the laser light emitted with the drying unit 14 to the ILS 16 which is the light amount measurement device. The basic configuration of the correction optical system 18 is illustrated in FIG. 1. The light flux L is turned at 90° with each of the mirrors 18*a* and 18*b* to arrive at a light reception surface of the ILS 16. As will be described, the light flux L from the drying unit 14 has a width in the Y axis direction. Therefore, the mirror 18*a* is configured to scan the light flux L with the width and guide the light flux L to the ILS 16 while is moved in the Y axis direction. In the following embodiment, the case in which the mirrors 18*a* and 18*b* are used as an optical system that guides the light flux of the laser light emitted from the drying unit 14 to the ILS 16 has been exemplified in the description. However, the invention is not limited thereto and another optical element, e.g., a triangular prism, may be used.

The sheet feeding roll 22 is a portion that supplies the continuous paper sheet P to the head unit 26 and the continuous paper sheet P is wound around this roll. The sheet feeding roll 22 is held to be rotatable about a frame member (not illustrated).

The winding roll 24 is a portion around which the continuous paper sheet P on which the image is formed is wound around the roll. The winding roll 24 receives a rotational force from a motor (not illustrated) to be rotated so that the continuous paper sheet P is transported in the sheet transport direction.

The control unit 20 controls each unit of the image forming apparatus 10 as a whole. The details of the control unit 20 will be described.

The image forming apparatus 10 having the foregoing configuration operates as follows. That is, a tensile force in the sheet transport direction is given to the continuous paper sheet P by rotating the winding roll 24, and then the continuous paper sheet P supplied from the sheet feeding roll 22 is transported in the sheet transport direction. Ink droplets are first landed on the front surface of the continuous paper sheet P transported in the sheet transport direction by the head unit 26 so that the printing is performed on the front surface. The printed continuous paper sheet P is transported to the drying unit 14 to be dried. As necessary, the mage printed on the dried continuous paper sheet P is read with the ILS 16 to generate image data, and thus a printed state is monitored using the generated image data.

Next, the drying unit 14 according to the embodiment will be described with reference to FIG. 2. As illustrated in (a) of FIG. 2, the drying unit 14 includes a plurality of drying blocks B-1 to B-8 (hereinafter collectively referred to as the "drying blocks B") (eight drying blocks B-1 to B-8 are exemplified in FIG. 3(*a*)) arranged in a direction (X axis direction) orthogonal (intersecting) to the sheet transport direction (+Y direction). Each drying block B includes a plurality of VCSEL elements UV (16 VCSEL elements are exemplified in FIG. 3(*a*)) arranged in the sheet transport direction (Y axis direction). When the printed continuous paper sheet P is dried, the VCSEL elements UV are each caused to emit light.

In the embodiment, the case in which the number of drying blocks B included in the drying unit 14 is 8 and the number of VCSEL elements UV included in each drying block is 16 has been exemplified in the description. However, the number of drying blocks B and the number of VCSEL elements UV are not limited thereto and appropriate numbers may be selected according to the required drying capability or the like. The VCSEL element UV is not limited to the single VCSEL element, but may be a VCSEL array in which a plurality of VCSEL elements are arranged in an array shape.

Next, a method of controlling the amount of light in the drying unit 14 will be described with reference to (b) of FIG. 2. The amount of light of the VCSEL element is generally controlled with a driving current flowing in the VCSEL element. In the drying unit 14 according to the embodiment, the amount of light is also controlled with a driving current flowing in each VCSEL element UV.

In the drying unit 14 according to the embodiment, the driving current is controlled in units of the drying blocks B, for example. Therefore, a driving circuit (driver) controlling the driving current is connected to each drying block B. That is, a driver D1 controlling a driving current I1 flowing in the drying block B-1 is connected to the drying block B-1. Similarly, drivers D2 to D8 controlling driving currents I2 to I8 are connected to the drying blocks B-2 to B-8, respectively. In the embodiment, the case in which the driving current is controlled in the units of the drying blocks B has been exemplified in the description, but the invention is not limited thereto. For example, the driving current may be controlled in units of the VCSEL elements UV.

Next, the configuration of main units of an electric system in the image forming apparatus 10 including the control unit 20 will be described with reference to FIG. 3.

Figure 3:
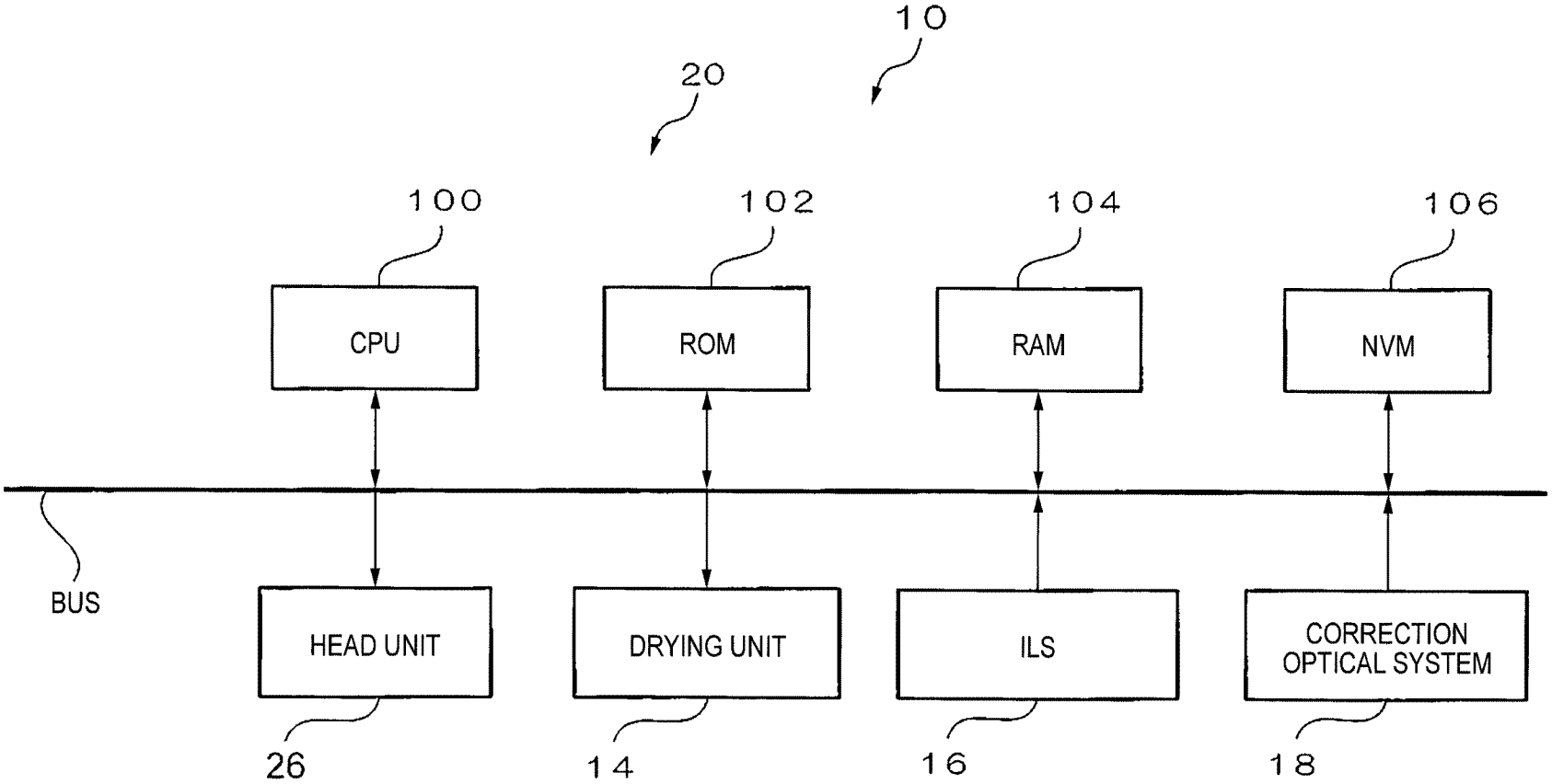
FIG. 3 is a block diagram illustrating an example of the configuration of main units of an electric system of the image forming apparatus according to the embodiment.

As illustrated in FIG. 3, the control unit 20 according to the embodiment includes a central processing unit (CPU) 100, a read-only memory (ROM) 102, a random access memory (RAM) 104, and a nonvolatile memory (NVM) 106. The CPU 100, the ROM 102, the RAM 104, and the NVM 106 are connected to each other via a bus BUS.

The CPU 100 controls the entire image forming apparatus 10 as a whole. The ROM 102 is a storage unit that stores various programs such as a control program controlling an operation of the image forming apparatus 10 and a light amount correction processing program to be described below, various parameters, or the like in advance. The RAM 104 is a storage unit that is used as a work area or the like when various programs are executed. The NVM 106 is a nonvolatile storage medium that stores various kinds of information to be maintained even when a power switch of the image forming apparatus 10 is powered off.

The head unit 26, the drying unit 14, the ILS 16, and the correction optical system 18 described above are connected to the bus BUS. The head unit 26, the drying unit 14, the ILS 16, and the correction optical system 18 are connected to each configuration of the control unit 20 such as the CPU 100 via the bus BUS and are controlled by the CPU 100.

The head unit 26 is controlled by the CPU 100 such that the head unit 26 prints an image on the continuous paper sheet P based on image data. The drying unit 14 is controlled by the CPU 100 such that the drying unit 14 dries the print surface of the printed continuous paper sheet P. The ILS 16 is controlled by the CPU 100 so that the ILS 16 measures the amount of light of each VCSEL element UV of the drying unit 14 when the light amount correction of the drying unit 14 is performed. The correction optical system 18 is controlled by the CPU 100 such that the light flux of the light emitted from the VCSEL elements UV is scanned toward the ILS 16 when the light amount correction of the drying unit 14 is performed.

Incidentally, with acceleration of the image forming apparatus, particularly, an inkjet type image forming apparatus, a dryer with high density and high output is necessary as a dryer that dries ink on the print surface of a recording medium. A dryer (laser dryer) using a laser is examined as the dryer corresponding to such a request.

Of various laser devices, VCSEL elements having good characteristics in which cost is relatively low, power consumption is low, two-dimension realization is easily achieved, and modulation can be performed rapidly are expected to be used. In such a laser dryer, for example, the VCSEL elements are arranged in an array shape in the width direction (main scanning direction) of a recording sheet which is a recording medium and the transport direction (sub-scanning direction) of the recording sheet so that the VCSEL is configured as a VCSEL array.

Incidentally, in the laser dryer using the VCSEL array, cooling irregularity of a cooler equipped in the laser dryer, characteristic variation due to production lot of the laser dryer, characteristic variation between a plurality of drying units included in the laser dryer, and light amount irregularity caused due to deterioration or the like over time occur. The light amount irregularity is a factor causing drying irregularity of a print on which printing is performed on a recording sheet. Further, the drying irregularity causes density irregularity of a print image and deteriorates the quality of a final print. Accordingly, from the viewpoint of suppressing the deterioration in the quality of the print, it is necessary to suppress the light amount irregularity of the laser dryer. To suppress the light amount irregularity, the amount of light emitted from the VCSEL elements included in the laser dryer is required to be corrected so that the amount of light in the VCSEL array is regular or a targeting light amount distribution is obtained.

As one of the methods of causing the amount of light in the VCSEL array to be regular, there is a method of acquiring initial data regarding the amount of light at the time of manufacturing of the VCSEL array and correcting the light amount irregularity in the image forming apparatus after the VCSEL array is mounted in the image forming apparatus based on the data. However, in the related method, the light amount irregularity caused due to an "installation error," "temporal deterioration," and "cooling capability change" after the mounting on the image forming apparatus may not be corrected. For this reason, it is necessary to provide a method of measuring the amount of light in the VCSEL array initially or periodically in the image forming apparatus and correcting the amount of light n the image forming apparatus so that the amount of light is regular.

As one of the methods corresponding to the periodic correction in the image forming apparatus, there is a method of using an image reading function of the ILS mounted on the image forming apparatus. That is, this method is a scheme of drying a print (printed recording medium) with the laser dryer, subsequently reading the print surface with the ILS to acquire image data, determining irregularity of the amount of light of the laser dryer from light and shade of an image in the acquired image data, and correcting the amount of light of the laser dryer based on the determined irregularity of the amount of light.

The irregularity of the amount of light in accordance with the light and shade of the image is determined based on the phenomenon in which ink droplets landed on a recording medium are deviated from target positions on the recording medium before being dried by the laser dryer. Accordingly, even in printing based on the same image data, the degree of density irregularity differs, for example, between when the recording medium to be printed is a sheet and when the recording medium to be printed is a polyethylene-terephthalate (PET) film. When the degree of density irregularity differs in accordance with a recording medium, it is difficult to decide the correspondence between the degree of density irregularity and light amount irregularity to be corrected. That is, in the method of reading a print with the ILS and correcting the light amount irregularity, an error occurs in accordance with the kind of recording medium. Therefore, for example, it is necessary to contrive means such as fixing of the kind of recording medium when the light amount irregularity is corrected, and thus inconvenience occurs.

Accordingly, in the embodiment, the amount of light of the laser dryer is reed directly with the ILS and the amount of light of the laser dryer is corrected using the reading result. In this way, in the liquid droplet drying device and the image forming apparatus according to the embodiment, the amount of light (luminance) of the laser dryer is directly measured. Therefore, an error caused due to the kind of recording medium is decreased, and thus the amount of light of the laser dryer is corrected. As a result, it is not necessary to exchange a recording medium during use in printing and it is not necessary to use a recording medium for correction use.

An image forming apparatus 10A according to the embodiment will be described with reference to FIG. 4. In the image forming apparatus 10A, the correction optical system 18 of the image forming apparatus 10 having the basic configuration is modified to a correction optical system 18A. Accordingly, since the head unit 26, the drying unit 14, the ILS 16, the control unit 20, the sheet feeding roll 22, and the winding roll 24 are the same as those of the image forming apparatus 10, the same reference numerals are given and the description thereof will be omitted. As will be described, the image forming apparatus 10A includes two drying units 14-1 and 14-2 as the drying unit 14.

Figure 4:
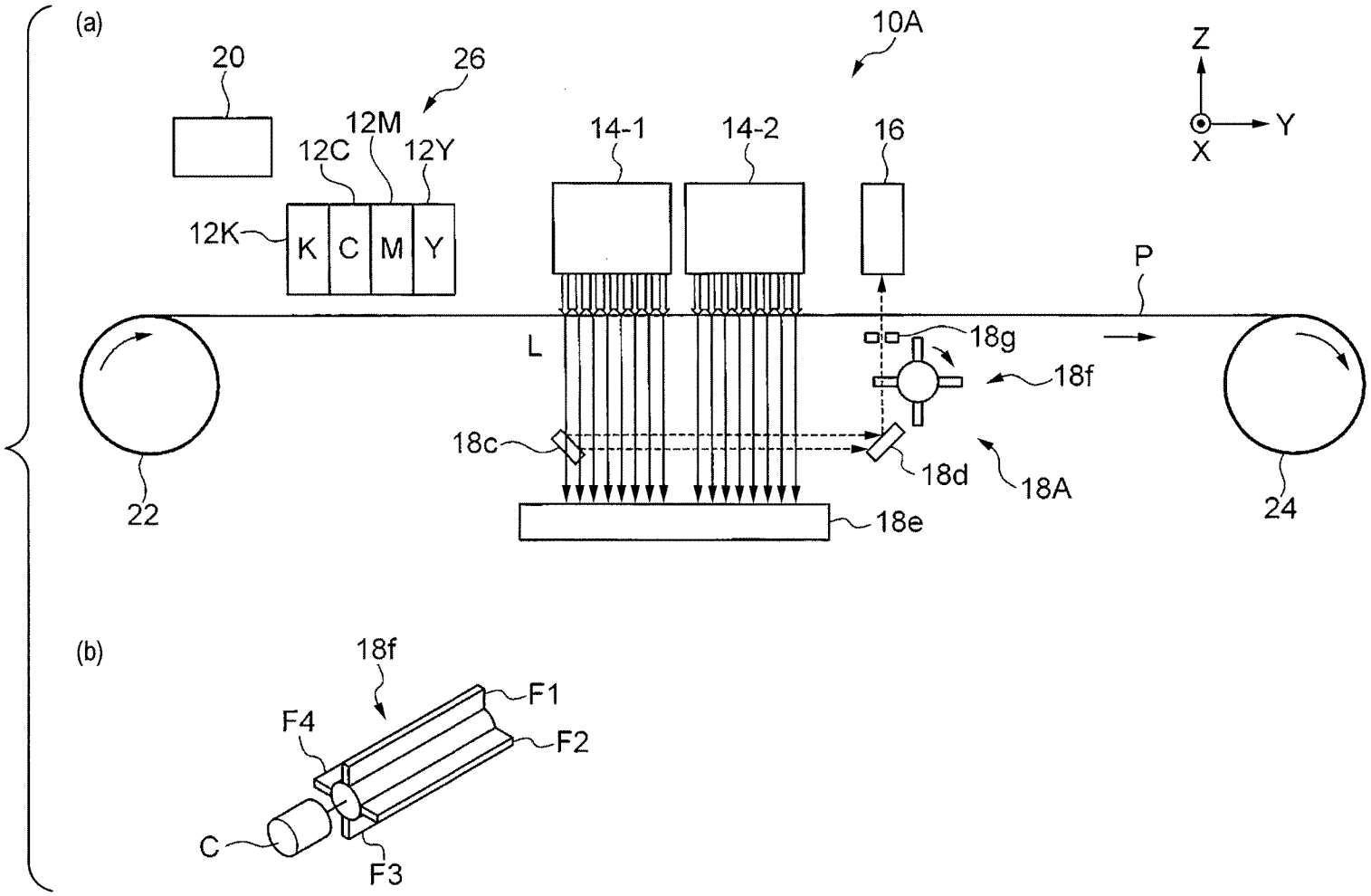
FIG. 4 is a schematic configuration diagram illustrating an example of the configuration of the image forming apparatus according to a first embodiment.

As illustrated in (a) of FIG. 4, a correction optical system according to the embodiment includes a half mirror 18*c*, a mirror 18*d*, a light absorption member 18*e*, a variable attenuation filter 18*f*, and a slit 18*g*. In the embodiment, the transport of the continuous paper sheet P is stopped, but cutting is not performed.

The half mirror 18*c* corresponds to the mirror 18*a* of the above-described image forming apparatus 10 and is moved in the Y axis direction so the light flux L emitted from the VCSEL element UV of the drying unit 14 is guided to the ILS 16 via the mirror 18*d* to be scanned.

The reason why the mirror 18*a* is changed to the half mirror 18*c* is that the amount of light flux L is attenuated so that the amount of light incident on the ILS 16 is not excessively input. When there is no concern of the amount of light being excessive, the mirror 18*a* may be used without being changed.

The mirror 18*d* corresponds to the mirror 18*b* of the image forming apparatus 10 and further turns the light flux L turned by the half mirror 18*c* to guide the light flux L to the ILS 16. The mirror 18*d* may be a half mirror to attenuate the amount of light flux L. At this time, the light absorption member to be described below may be disposed to observe the light transmitted through the half mirror.

The light absorption member 18*e* is a member that absorbs the transmitted light so that the light transmitted through the half mirror 18*c* does not become stray light inside the image forming apparatus 10A.

The variable attenuation filter 18*f* is a filter that further attenuates the amount of light flux L. (b) of FIG. 4 illustrates the configuration of the variable attenuation filter 18*f* according to the embodiment. As illustrated in (b) of FIG. 4, the variable attenuation filter 18*f* includes filters F1 to F4 with different attenuation rates arranged in the same axis shape and rotates the filters F1 to F4 about a rotation axis C so that the attenuation rates are changed according to the amount of light incident on the ILS 16.

Here, in the embodiment, the amount of light of the drying unit 14 is corrected in the state in which the continuous paper sheet P is spread between the sheet feeding roll 22 and the winding roll 24. Therefore, the amount of light flux L of the drying unit 14 is transmitted through the continuous paper sheet P is attenuated. On the other hand, there are kinds of continuous paper sheets P used in the image forming apparatus 10A, and thus the recording medium is not limited to the continuous paper sheet. Therefore, the attenuation rate is different according to the kind of recording medium. To handle the attenuation rates of the different kinds of recording media, the variable attenuation filter 18*f* is adopted in the correction optical system 18A of the image forming apparatus 10A. In the embodiment, the variable attenuation filter 18*f* including the four filters F1 to F4 with different attenuation rates has been exemplified in the description, but the invention is not limited thereto. Several filters may be used according to the kinds of required attenuation rates or the like.

The slit 18*g* is a member that restricts the amount of light flux L and is provided to match the shape and the size of the cross section of the light flux L with the light reception surface of the ILS 16. When the attenuation rate is sufficient in the members up to the slit 18*g* and the cross-sectional shape or the like of the light flux L conforms to the light reception surface of the ILS 16, the slit 18*g* may not necessarily be used.

Figure 5:
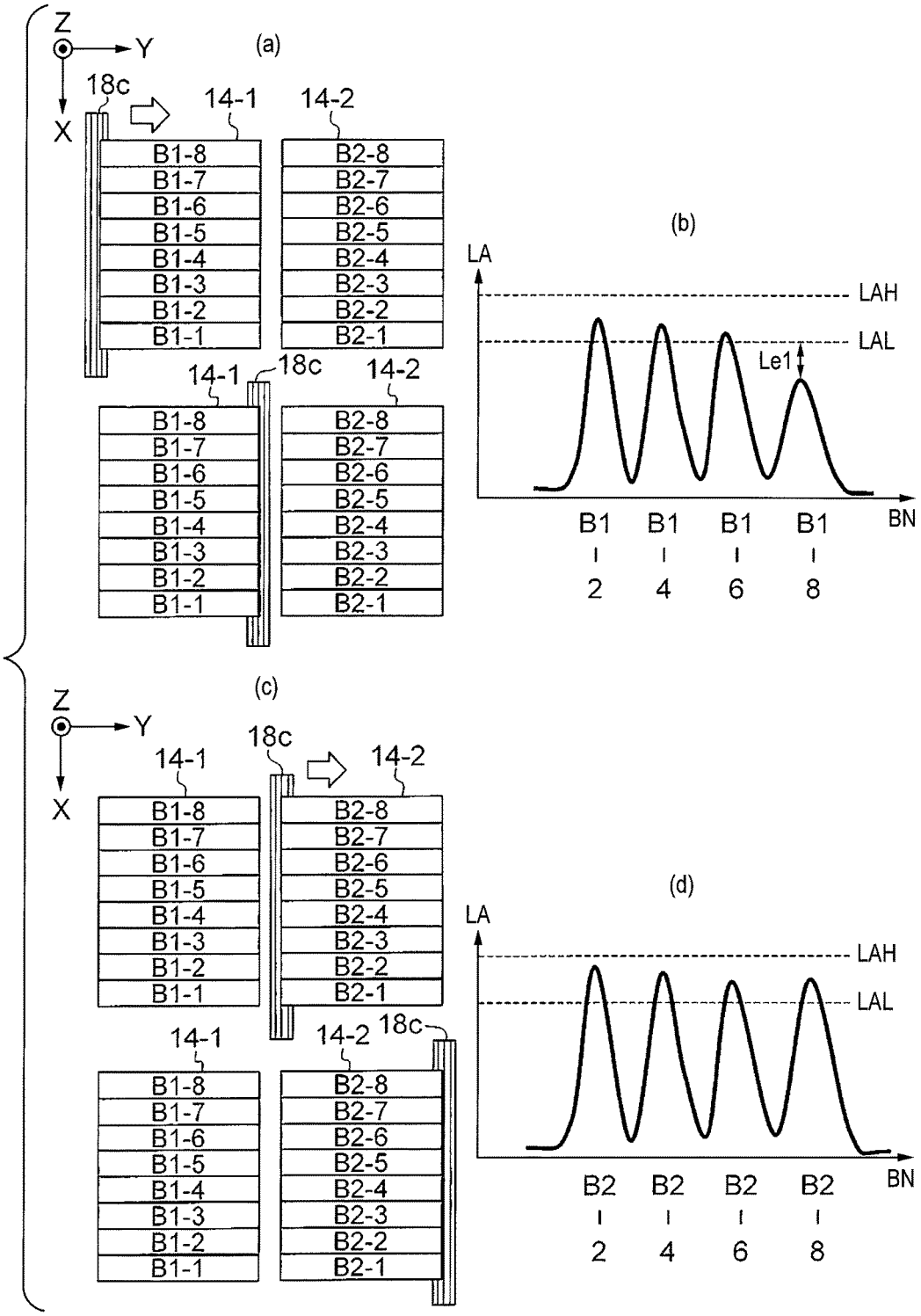
FIG. 5 is a partial diagram illustrating a light amount correction method according to the first embodiment.
Figure 6:
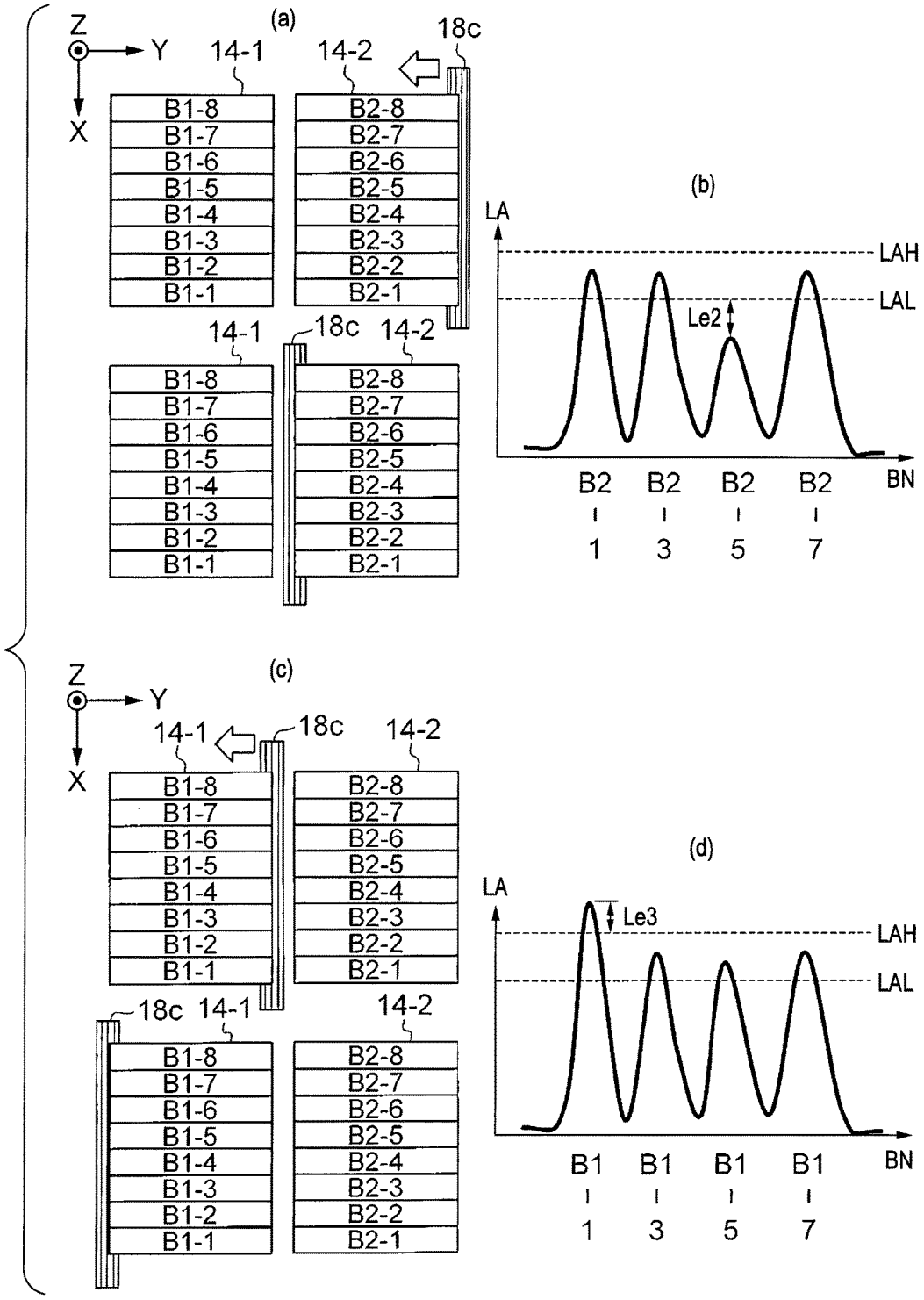
FIG. 6 is a partial diagram illustrating a light amount correction method according to the first embodiment.
Figure 7:
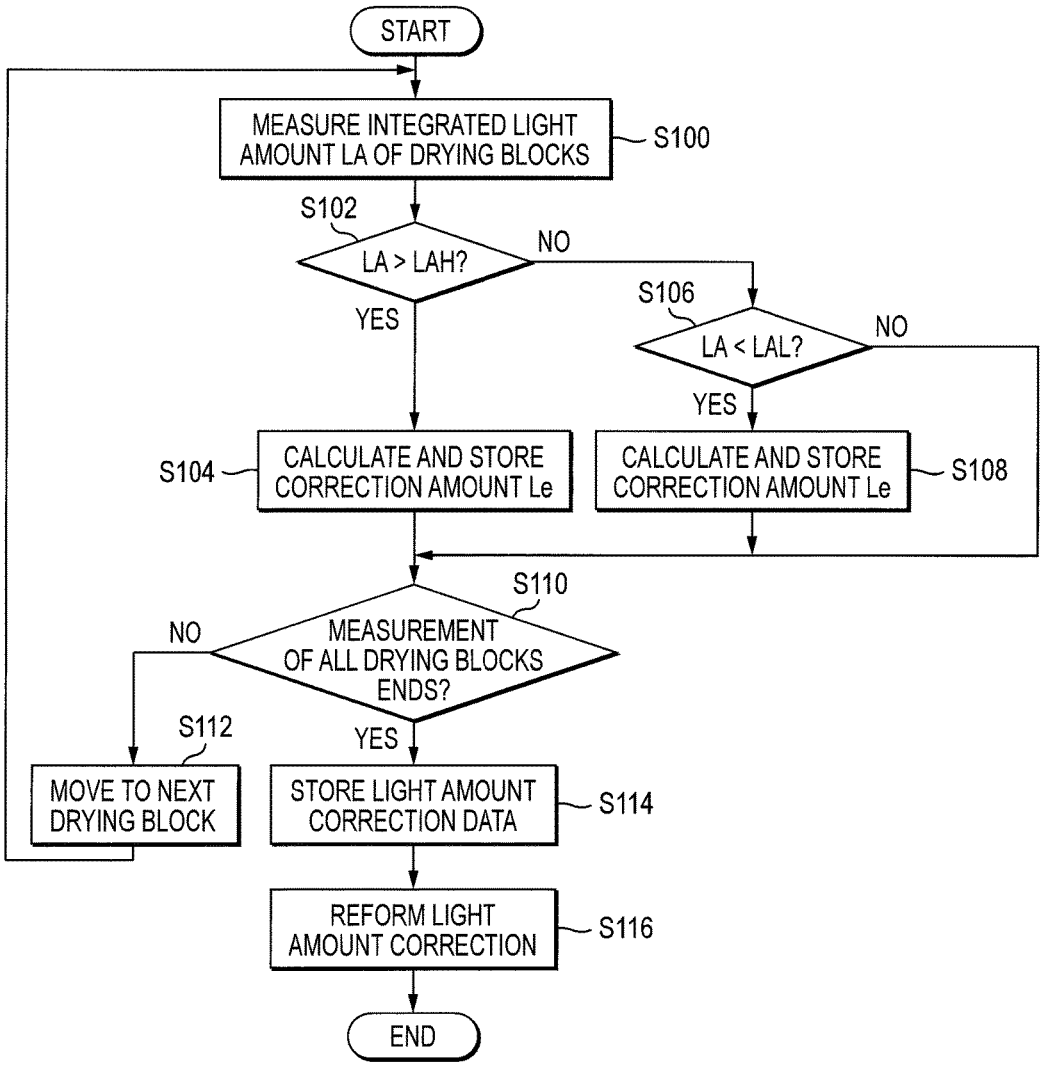
FIG. 7 is a flowchart illustrating a process flow of a light amount correction processing program according to the first embodiment.

Next, a light amount correction method of the drying unit 14 according to the embodiment will be described in more detail with reference to FIGS. 5 to 7. As described above, the drying unit 14 of the image forming apparatus 10A includes the two drying units 14-1 and 14-2. As illustrated in FIGS. 5 and 6, the drying unit 14-1 includes eight drying blocks, drying blocks B1-1 to B1-8 and the drying unit 14-2 includes eight drying blocks, drying blocks B2-1 to B2-8.

FIGS. 5 and 6 illustrate a series of operation states when the half mirror scanned in the Y axis direction and the amount of light of the drying unit 14 is measured by the ILS 16. FIG. 7 is a flowchart illustrating a process flow of a light amount correction processing program which is a program correcting the amount of light of the drying unit 14 according to the embodiment.

(a) of FIG. 5 is a plan view illustrating a state in which the half mirror 18*c* is moved from in the −Y direction to the +Y direction and the drying unit 14-1 is scanned. In a light amount correction process according to the embodiment, the drying blocks B are caused to emit light alternately. In (a) of FIG. 5, the even drying blocks B1-2, B1-4, B1-6, and B1-8 of the drying unit 14-1 are caused to light emit and the half mirror 18*c* is scanned to acquire an integrated light amount LA. At this time, the odd drying blocks B1-1, B1-3, B1-5, and B1-7 are caused to stop emitting the light.

(b) of FIG. 5 is a graph illustrating the integrated light amount LA of the drying blocks B1-2, B1-4, B1-6, and B1-8 of the drying unit 14-1 in which the horizontal axis represents a reference sign BN of the drying block and the vertical axis represents the integrated light amount LA. In the embodiment, as illustrated in (a) of FIG. 2, when the drying blocks B are scanned in the Y axis direction, the amounts of light of the sixteen VCSEL elements UV are sequentially read to be integrated, and thus the integrated light amount LA is acquired for each drying block B. In the embodiment, by reading the amounts of light of the drying blocks B alternately, a profile (distribution shape) of the integrated light amount LA is separated. When the profile of the integrated light amount is not separated, the eight drying blocks B may be caused to emit the light at a time and may be scanned with the half mirror 18*c*.

In the embodiment, as described above, the amounts of light of the VCSEL elements UV are controlled in units of the drying blocks B. Whether it is necessary to correct the amount of light of each drying block is decided by comparing a peak value of the integrated light amount LA and a target value of the integrated light amount LA for each drying block B. In the embodiment, an upper limit target value LAH and a lower limit target value LAL are provided as target values of the peak value of the integrated light amount LA. The peak value of the integrated light amount LA of each drying block B is greater than the upper limit target value LAH or is less than the lower limit target value LAL, it is determined that it is necessary to correct the amount of light. A difference between the peak value of the integrated light amount LA measured at that time and the upper limit target value LAH or the lower limit target value LAL is assumed to be a correction amount Le.

Figure 2:
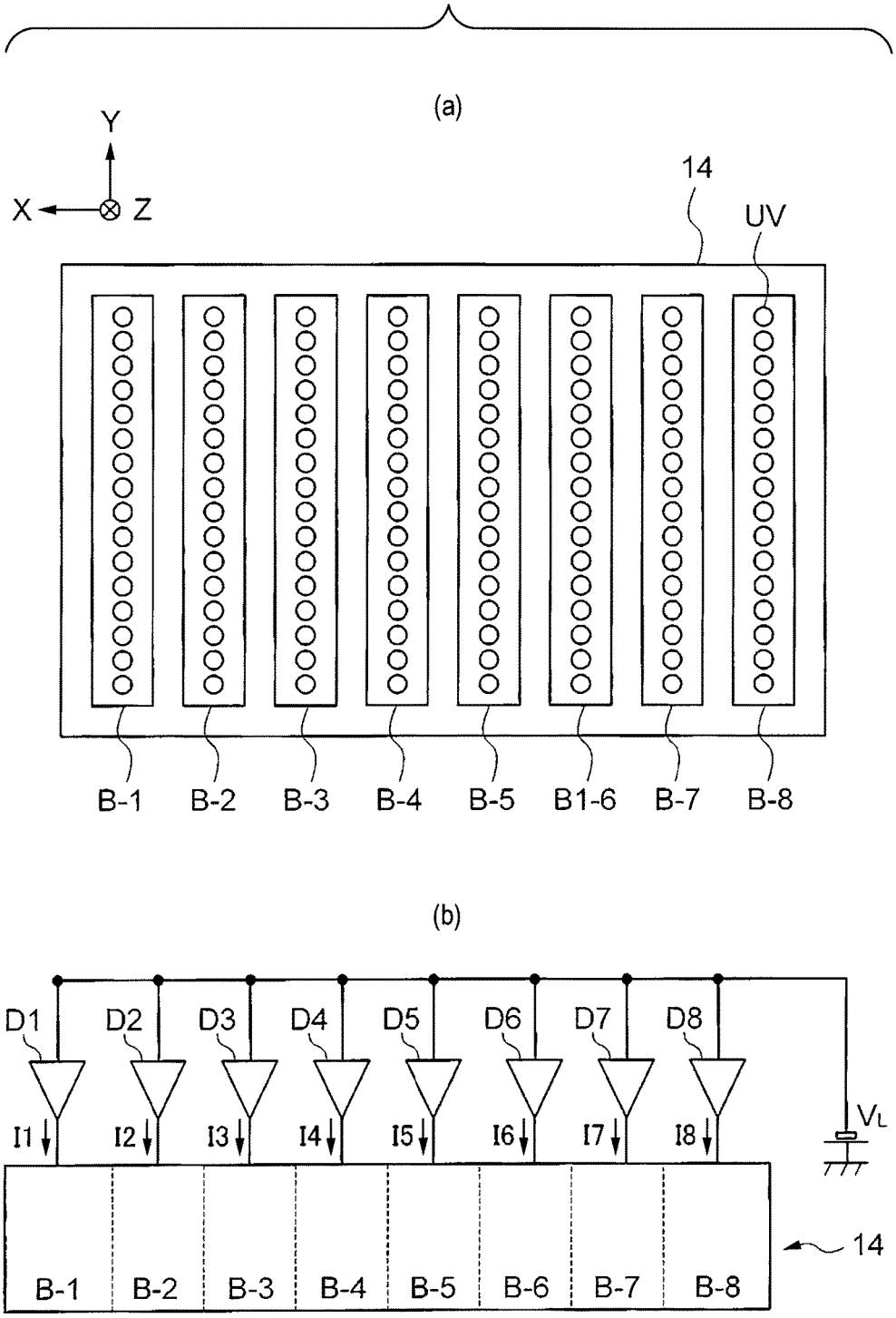
FIG. 2 is a plan view illustrating the configuration of a drying unit according to the embodiment and is a diagram illustrating a control circuit of drying blocks.

In the embodiment, the upper limit target value LAH and the lower limit target value LAL may be decided in advance to the extent of suppression of the drying irregularity of the sheet width direction (the X axis direction: see (a) of FIG. 2) and may be stored in a storage unit such as the ROM 102.

The upper limit target value LAH and the lower limit target value LAL are set in consideration of an optical loss from the light emission surface of the VCSEL element UV of the drying unit 14 to the light reception surface of the ILS 16 (a sum of the losses in the half mirror 18*c*, the mirror 18*d*, the variable attenuation filter 18*f*, and the slit 18*g*), that is, so that the amount of light emitted from the drying unit 14 decreases by the optical loss. However, the invention is not limited thereto. The upper knit target value LAH and the lower limit target value LAL may be set in regard to the output amount of light from the drying unit 14 and the measured integrated light amount LA may be corrected to increase by the optical loss.

In the case of (a) of FIG. 5, it is not necessary to correct the amounts of light of the drying blocks B1-2, B1-4, and B1-6 and it is necessary to correct the amount of light of the drying block B1-8. At this time, the correction amount is determined to be Le1. The foregoing measurement result may be temporarily stored in a storage unit such as the RAM 104.

(c) of FIG. 5 illustrates a state in which the drying blocks B2-2, B2-4, B2-6, and B2-8 of the drying unit 14-2 are caused to continuously emit the light and are scanned in the +Y direction by the half mirror 18*c*. (d) of FIG. 5 illustrates the integrated light amount LA of each drying block 13 acquired through the scanning. At this time, the drying blocks B2-1, B2-3, B2-5, and B2-7 are caused to stop emitting the light. Referring to (d) of FIG. 5, the peak value of the integrated light amount LA of the drying blocks B2-2, B2-4, B2-6, and B2-8 is a value between the upper limit target value LAH and the lower limit target value LAL.

Therefore, it is determined that it is not necessary to correct the amount of light of any drying block B.

(a) of FIG. 6 illustrates a state in which the drying blocks B2-1, B2-3, B2-5, and B2-7 of the drying unit 14-2 are caused to continuously emit the light and are scanned in the −Y direction by the half mirror 18*c*. (b) of FIG. 6 illustrates the integrated light amount LA of each drying block B acquired through the scanning. At this time, the drying blocks B2-2, B2-4, B2-6, and B2-8 are caused to stop emitting the light. Referring to (d) of FIG. 6, it is determined that it is not necessary to correct the amounts of light of the drying blocks B2-1, B2-3, and B2-7 and it is necessary to correct the amount of light of the drying block B2-5, and the correction amount is Le2 at that time. The foregoing measurement result may be temporarily stored in a storage unit such as the RAM 104.

(c) of FIG. 6 illustrates a state in which the drying blocks B1-1, B1-3, B1-5, and B1-7 of the drying unit 14-1 are caused to continuously emit the light and are scanned in the −Y direction by the half mirror 18*c*. (d) of FIG. 6 illustrates the integrated light amount LA of each drying block B acquired through the scanning. At this time, the drying blocks B1-2, B1-4, B1-6, and B1-8 are caused to stop emitting the light. Referring to (d) of FIG. 6, it is determined that it is not necessary to correct the amounts of light of the drying blocks B1-3, B1-5, and B1-7 and it is necessary to correct the amount of light of the drying block B1-1, and the correction amount is Le3 at that time. The foregoing measurement result may be temporarily stored in a storage unit such as the RAM 104.

The integrated light amounts LA of all of the drying blocks B of the drying units 14-1 and 14-2 are acquired in the foregoing order, and the identification number of the drying block for which it is necessary to correct the amount of light is stored as light amount correction data along with the correction amount Le in a storage unit such as the RAM 104. The CPU 100 reads the light amount correction data from the storage unit such as the RAM 104, controls the driver D (see (b) of FIG. 2) of the drying block B for which it is necessary to correct the amount of light, changes the driving current value of the drying block B, that is, performs feedback control so that the driving current I flowing to the drying block B increases when the integrated light amount LA is less than the lower limit target value LAL and the driving current I flowing in the drying block B decreases when the integrated light amount LA is greater than the upper limit target value LAH, and corrects the amount of light.

Next, the light amount correction processing program according to the embodiment will be described with reference to FIG. 7. FIG. 7 is a flowchart illustrating a process flow of the light amount correction processing program according to the first embodiment. The process illustrated in FIG. 7 is executed when a user gives an instruction to start the execution via an input unit (not illustrated), and the CPU 100 of the control unit 20 reads the light amount correction processing program from a storage unit such as the ROM 102 and loads the light amount correction processing program in a storage unit such as the RAM 104.

In the embodiment, the case in which the light amount correction process is performed by the instruction of the user has been exemplified in the description, but the invention is not limited thereto. The image forming apparatus 10A may autonomously perform the light amount correction process periodically for each pre-decided period. In the embodiment, the case in which the light amount correction processing program is stored in advance in the storage unit such as the ROM 102 has been exemplified in the description, but the invention is not limited thereto. For example, the light amount correction processing program may be stored in a storage medium such as a Compact Disk Read Only Memory (CD-ROM) to be supplied or may be supplied via a network.

In step S100, the integrated light amount LA of each drying block B is first measured in the above-described order. In the embodiment, as described above, the integrated light amount LA of the drying blocks B of the drying unit 14 is measured alternately. The measured integrated light amount LA is converted into a digital value and is temporarily stored in a storage unit such as a RAM.

Next, in step S102, it is determined whether the integrated light amount LA measured in step S100 is greater than the upper limit target value LAH. When this determination is negative, the process proceeds to step S106. Conversely, when this determination is positive, the process proceeds to step S104 to calculate the correction amount Le and stores the correction amount Le in a storage unit such as the RAM 104.

In step S106, it is determined whether the integrated light amount LA measured in step S100 is less than the lower limit target value LAL. When this determination is negative, the process proceeds to step S110. Conversely, when this determination is positive, the process proceeds to step S108 to calculate the correction amount Le and stores the correction amount Le in a storage unit such as the RAM 104.

In step S110, it is determined whether the measurement of the integrated light amount LA of all of the drying blocks B ends. When this determination is positive, the process proceeds to step S114. Conversely, when this determination is negative, preparation for moving to the subsequent drying block B is made in step S112, and then the process proceeds to step S100 to continue the measurement of the integrated light amount LA of the drying block B.

In step S114, light amount correction data obtained in the process up to step S112 is stored in a storage unit such as the NVM 106.

Next, in step S116, the amount of light of the drying block B for which the light amount correction is necessary among the drying blocks B is corrected. That is, as described above, feedback control is performed such that the driving current I flowing the drying block B increases when the integrated light amount LA is less than the lower limit target value LAL, and the driving current I flowing in the drying block B decreases when the integrated light amount LA is greater than the upper limit target value LAH. Thereafter, the light amount correction processing program ends.

For example, to improve precision of the correction, as necessary, a process of measuring the integrated light amount LA again for each drying block B and correcting the amount of light of each drying block B again may be repeated after the light amount correction processing program ends.

In the foregoing embodiment, the case in which the uniform upper limit target value LAH and the uniform lower limit target value LAL are set as the target values of the integrated light amount LA (the integrated light amount LA in the Y axis direction: see (a) of FIG. 2) of each drying block B has been exemplified, but the invention is not limited thereto. For example, the target values of the integrated light amount LA of each drying block B may be changed according to a pattern (drying profile) of a drying region by the drying unit 14.

Second Embodiment

An image forming apparatus 10B according to an embodiment will be described with reference to FIG. 8. (a) of FIG.

Figure 8:
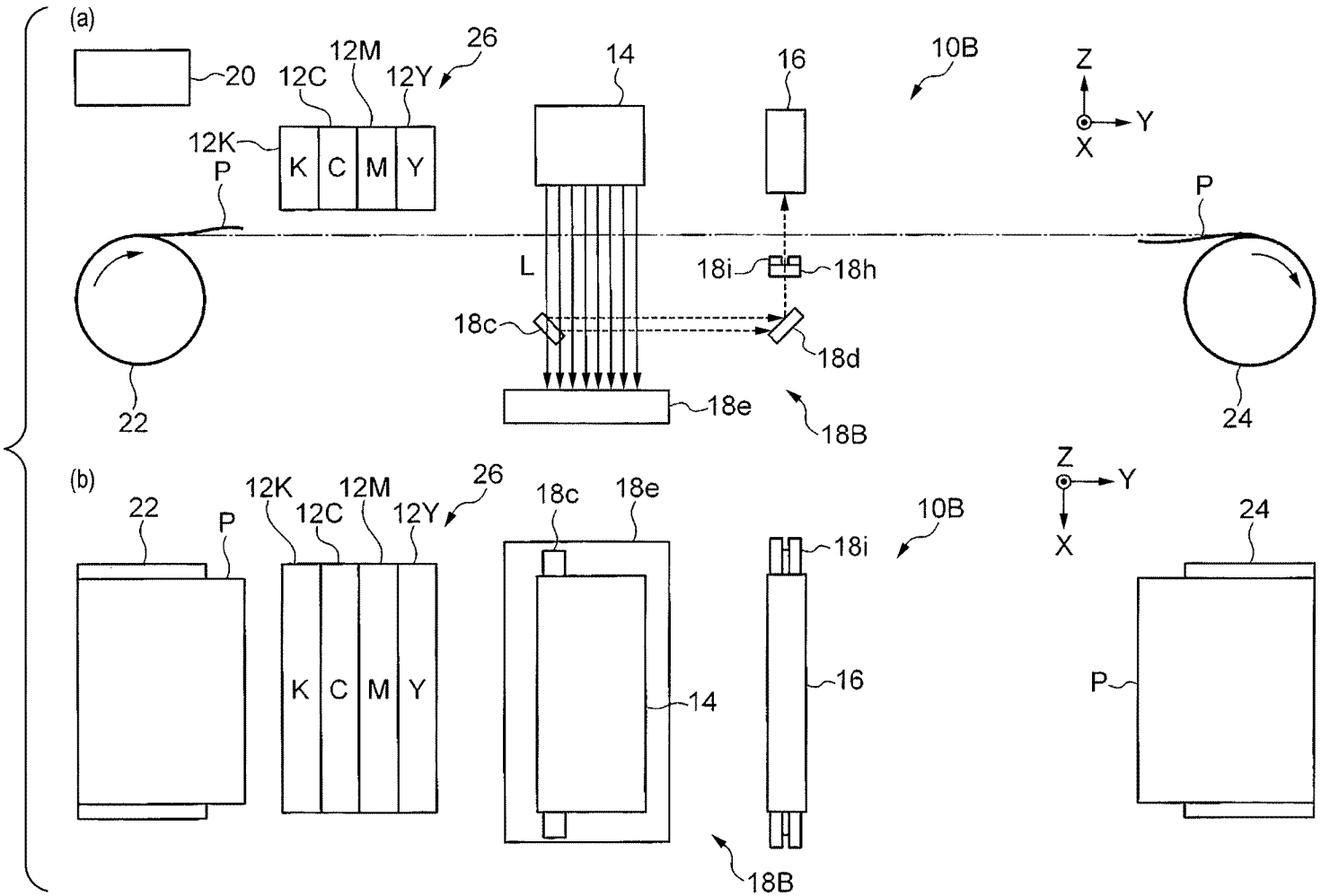
FIG. 8 is a schematic configuration diagram illustrating an example of the configuration of an image forming apparatus according to a second embodiment.

8 is a side view illustrating an image forming apparatus 10B and (b) of FIG. 8 is a plan view illustrating the image forming apparatus 10B. In the embodiment, the continuous paper sheet P is cut and the amount of light of the drying unit 14 is corrected. The image forming apparatus 10B is different from the image forming apparatus 10A, the correction optical system 18A is substituted with a correction optical system 18B. The other remaining configuration is the same as that of the image forming apparatus 10A. Thus, the same reference numerals are given and the description thereof will be omitted. In the embodiment, a case in which one drying unit 14 is used will be exemplified in the description.

The correction optical system 18B according to the embodiment includes a half mirror 18*c*, a mirror 18*d*, a light absorption member 18*e*, an attenuation filter 18*h*, and a slit 18*i*. The half mirror 18*c*, the mirror 18*d*, the light absorption member 18*e* have the same configurations and the same functions as those of the correction optical system 18A. In the correction optical system 18B, the variable attenuation filter 18*f* and the slit 18*g* of the correction optical system 18A are substituted with a fixed attenuation filter 18*h* and a slit 18*i*. In the image forming apparatus 10B, the half mirror 18*c* is also moved in the Y axis direction and the light flux L emitted from the drying unit 14 is scanned to measure the integrated light amount LA of the drying blocks B of the drying unit 14.

In the image forming apparatus 10A, the amount of light is corrected when the continuous paper sheet P is fed. Therefore, it is necessary to adjust an attenuation amount of the correction optical system 18A to match the attenuation rate of the amount of light flux L from the drying unit 14 in accordance with the continuous paper sheet P. In contrast, in the image forming apparatus 10B according to the embodiment, the continuous paper sheet P is cut when the amount of light is corrected. Therefore, it is not necessary to consider the attenuation of the amount of light in accordance with the continuous paper sheet P or a variation in the attenuation amount in accordance with a sheet kind of the continuous paper sheet P. Accordingly, the attenuation filter is configured as the fixed attenuation filter 18*h* and the slit 18*i* is formed to be integrated with the fixed attenuation filter 18*h*. Of course, the invention is not limited thereto. The slit 18*i* and the fixed attenuation filter 18*h* may be separated from each other to be individually provided.

In this way, in the image forming apparatus 10B according to the embodiment, it is not necessary to handle the attenuation of the amount of light of the drying unit 14 in accordance with the continuous paper sheet P (generally, a recording medium) and the variation in the amount of light. Therefore, the correction optical system is simplified and the amount of light is more accurately corrected.

Third Embodiment

Figure 9:
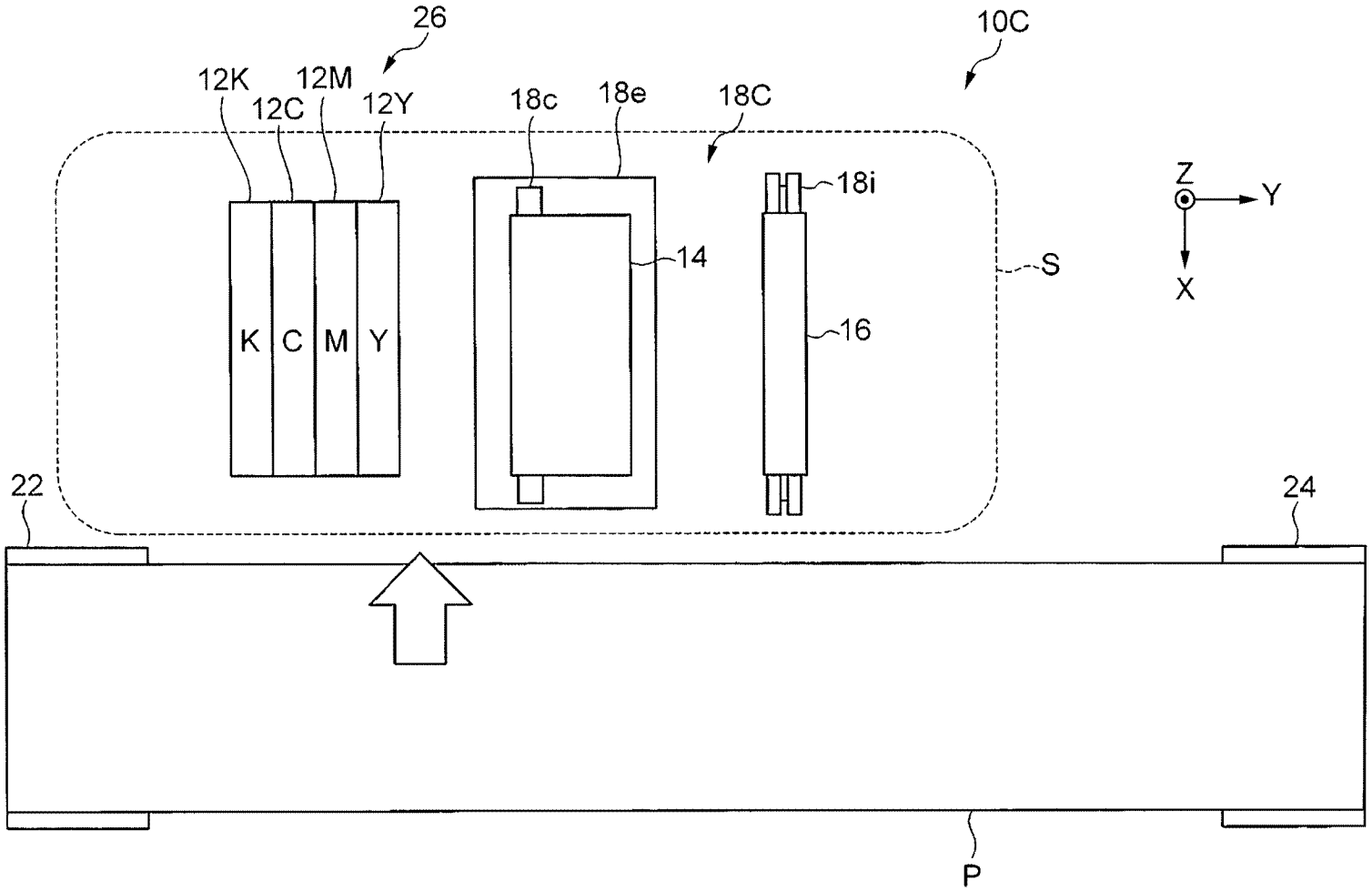
FIG. 9 is a schematic configuration diagram illustrating an example of the configuration of an image forming apparatus according to a third embodiment.

An image forming apparatus 10C according to an embodiment will be described with reference to FIG. 9. FIG. 9 is a plan view illustrating the image forming apparatus 10C. In the image forming apparatus 10C, the correction optical system is retreated to a maintenance position S so that the amount of light of the drying unit 14 is corrected. The image forming apparatus 10C is different from the image forming apparatus 10B only in that a retreat mechanism for retreat to the maintenance position is provided, and thus the description of each configuration will be omitted.

The maintenance position is a position to which the head unit 26 is moved to mainly maintain nozzles which are provided in the inkjet head 12 and eject ink droplets. Maintenance is performed such that the head unit 26 is retreated to the maintenance position, the inkjet head 12 is capped, dummy jet (empty ejecting) is performed from the nozzles of the inkjet head 12 to remove foreign matters attached in the nozzles, the ink droplets are normally ejected from the nozzles.

As illustrated in FIG. 9, the image forming apparatus 10C according to the embodiment is configured such that the drying unit 14, a correction optical system 18C, and the ILS 16 are repeated to the maintenance position S along with the head unit 26.

In the image forming apparatus 10C having the foregoing configuration, the drying unit 14, the correction optical system 18C, and the ILS 16 are each retreated to the maintenance position S and the light amount correction process of the drying unit 14 is performed in the above-described order.

In the image forming apparatus 10C according to the embodiment, it is not necessary to cut the continuous paper sheet P and the light amount correction process is efficiently performed. Since it is not necessary to measure the amount of light emitted from the drying unit 14 with the continuous paper sheet P interposed therebetween, the amount of light is corrected more accurately.

Fourth Embodiment

An image forming apparatus 10D according to an embodiment will be described with reference to FIG. 10. In the image forming apparatus 10D, the correction optical system 18B of the image forming apparatus 10B is substituted with a correction optical system 18D. The other remaining configuration is the same as that of the image forming apparatus 10B. Thus, the same reference numerals are given and the description thereof will be omitted. The image forming apparatus 10D includes a unit that converges the light flux L of the light emitted from the drying unit 14.

Figure 10:
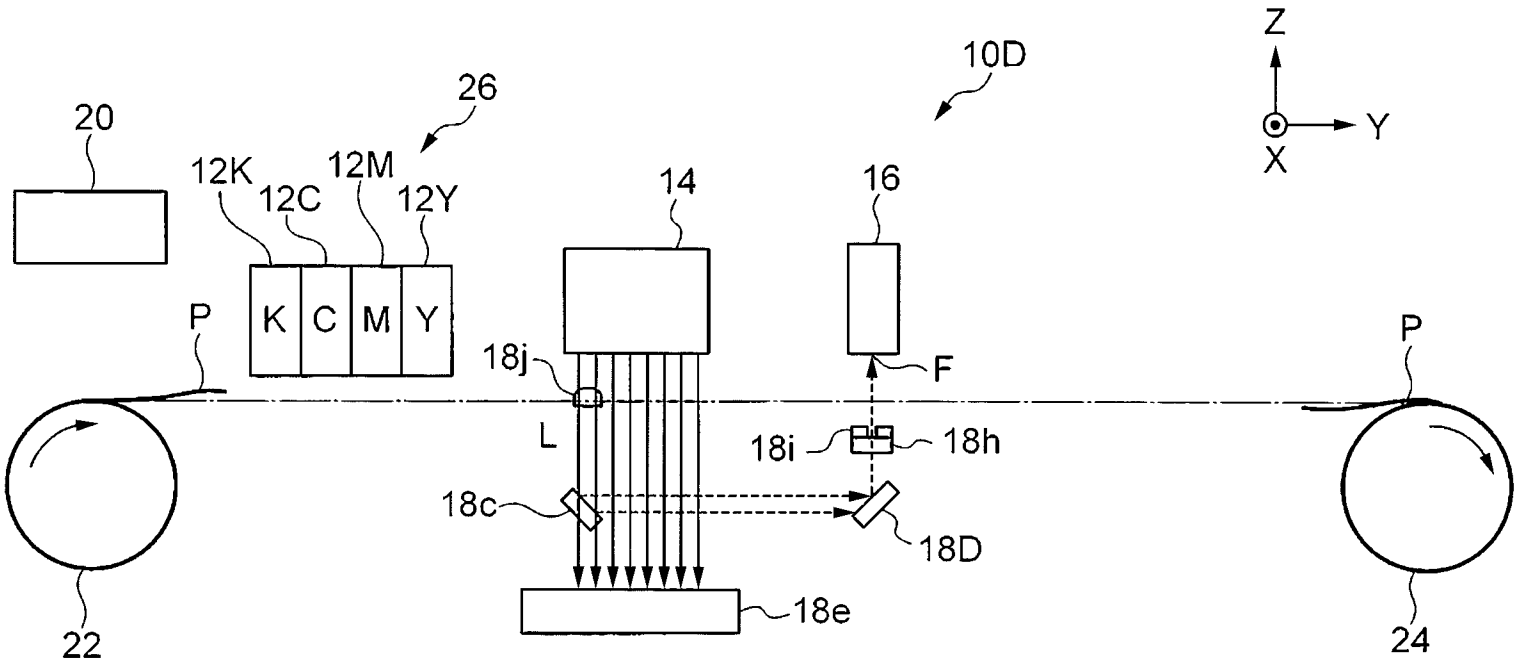
FIG. 10 is a schematic configuration diagram illustrating an example of the configuration of an image forming apparatus according to a fourth embodiment.

As illustrated in FIG. 10, the correction optical system 18D includes a lens 18*j*, a half mirror 18*c*, a mirror 18*d*, a fixed attenuation filter 18*h*, and a slit 18*i*. The half mirror 18*c*, the mirror 18*d*, the fixed attenuation filter 18*h*, and the slit 18*i* have the same functions as those of the correction optical system 18B. The correction optical system 18D according to the embodiment further includes the lens 18*j*.

The lens 18*j* is provided to suppress scattering of the light flux L of the light emitted from the drying unit 14 and is configured such that a focal point F is located, for example, on the light reception surface of the ILS 16. The lens 18*j* is configured to be movable with the half mirror 18*c* and scans the light flux L emitted from the drying unit 14 along with the half mirror 18*c*. The position of the lens 18*j* is not limited to the position illustrated in FIG. 10. For example, the lens 18*j* may be provided between the half mirror 18*c* and the mirror 18*d* or between the slit 18*i* and the ILS 16. For example, the lens 18*j* may be provided to be integrated with the half mirror 18*c*. When the lens 18*j* is provided, the slit 18*i* may be omitted as an element shaping the form of the light flux L.

In the image forming apparatus 10D configured in this way, scattering of the light flux L of the light emitted from the drying unit 14 is suppressed and the amount of light is measured. Therefore, the amount of light emitted from the drying unit 14 is measured more accurately. As a result, the more accurately light amount correction process is performed.

In the foregoing embodiments, the case in which the upper limit target value LAH and the lower limit target value LAL are set as the target values in the light amount correction of the integrated light amount LA of the drying blocks B in regard to the peak value of the integrated light amount LA of the drying blocks B has been described in the description, but the invention is not limited thereto. For example, one of the target values may be set to a target value LA0, a difference ΔLA=LA−LA0 between the measured integrated light amount LA and the target value LA0 may be feedback, and the driver D may be controlled so that the driving flow I flowing in each drying block B is changed. That is, the feedback control of the driver D is performed such that the drying current I of the drying block decrease when ΔLA is positive and the drying current I of the drying block increases when ΔLA is negative.

In the foregoing embodiments, the case in which the drying blocks B are arranged in the direction (the X axis direction) intersecting the sheet transport direction has been exemplified in the description, but the invention is not limited thereto. The drying blocks B may be arranged in the sheet transport direction (the Y axis direction).

In the foregoing embodiments, the case in which the continuous paper sheet is used as the recording medium has been exemplified in the description, but the invention is not limited thereto. A recording sheet cut with a constant size, for example, a so-called cut sheet, may be used.

In the foregoing embodiments, the case in which the invention is applied to simplex printing has been exemplified in the description, but the invention is not limited thereto. The invention is applied to duplex printing.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus A liquid droplet drying device comprising:

a forming unit;

a liquid droplet drying device including:

a drying unit that includes a plurality of light sources emitting light to a liquid droplet ejected to a recording medium by the forming unit which ejects the liquid droplet to form an image and drying the image and in which an amount of light of each of the plurality of light sources is variable;

a reading unit that directly reads the amount of light emitted from each of the plurality of light sources to obtain light amount information; and a correction unit that corrects the amount of light of each of the plurality of light sources so that a light amount distribution of the drying unit is within a range of a pre-decided target using the light amount information obtained by the reading unit;

wherein the plurality of light sources are arranged in a direction intersecting a transport direction of the recording medium, each of the plurality of light sources includes a plurality of edge-emitting semiconductor laser elements arranged in the transport direction of the recording medium, the liquid droplet drying device further comprises a light guiding unit which scans the light emitted from each of the plurality of light sources in the transport direction and guides the light to the reading unit, and the correction unit corrects the amount of light of each of the plurality of light sources by causing the light guiding unit to scan the light so that an integrated light amount of light emitted from the plurality of light sources is read by the reading unit and negatively feedbacking a difference between the integrated light amount of the plurality of light sources and the pre-decided target to the drying unit;

the liquid droplet drying device being disposed on a downstream side of the forming unit in the transport direction;

the reading unit being disposed on the downstream side of the liquid droplet drying device in the transport direction;

the recording medium being a roll sheet; and the light guiding unit being provided on an opposite side so that a transport path of the roll sheet is interposed between the light guiding unit and the drying unit.

2. The image forming apparatus according to claim 1, wherein the reading unit is configured by a charge-coupled device.

3. The image forming apparatus according to claim 1, wherein each of the plurality of light sources includes a plurality of vertical cavity surface emitting laser elements.

4. The image forming apparatus according to claim 1, wherein the light guiding unit includes an attenuation filter according to a kind of the recording medium.

5. The image forming apparatus according to claim 1, wherein the correction unit corrects the amount of light of each of the plurality of light sources in response to the roll sheet being supplied, and being present between the drying unit and the light guiding unit.

6. The image forming apparatus according to claim 1, wherein the light guiding unit includes a variable attenuation filter according to a kind of roll sheet.

7. The image forming apparatus according to claim 1, wherein the correction unit corrects the amount of light of each of the plurality of light sources in response to the roll sheet being cut, and being not present between the drying unit and the light guiding unit.

8. The image forming apparatus according to claim 1, further comprising:

a retreating mechanism which retreats the forming unit, the liquid droplet drying device, and the reading unit from the transport path of the recording medium to a retreat location when the forming unit is maintained, wherein the correction unit corrects the amount of light of each of the plurality of light sources when the forming unit, the liquid droplet drying device, and the reading unit are retreated to the retreat location by the retreating mechanism.

9. A non-transitory computer readable medium storing a liquid droplet drying program causing a computer to function as the correction unit of the image forming apparatus according to claim 1.

* * * * *